United States Patent [19]

Ellery, Sr.

[11] Patent Number: 4,589,598

[45] Date of Patent: May 20, 1986

[54] APPARATUS FOR CONTROLLING A VARIABLE SPEED GEARMOTOR

[75] Inventor: John M. Ellery, Sr., Pittsfield, Mass.

[73] Assignee: Beloit Corporation, Beloit, Wis.

[21] Appl. No.: 660,522

[22] Filed: Oct. 12, 1984

[51] Int. Cl.[4] ..... B02C 7/14

[52] U.S. Cl. ..... 241/37; 162/254; 162/261; 162/262; 241/33; 241/36; 364/471

[58] Field of Search ..... 241/33, 36, 37, 30; 364/469, 471, 152, 153, 154; 162/254, 261, 262, 263

[56] References Cited

U.S. PATENT DOCUMENTS 3,309,031 3/1967 McMahon et al. ..... 241/37

3,489,344 1/1970 Keyes, IV ..... 364/471 X 3,610,541 10/1971 Gudaz ..... 241/37

4,184,204 1/1980 Flohr ..... 364/471

*Primary Examiner*—Mark Rosenbaum

*Assistant Examiner*—Joseph M. Gorski

*Attorney, Agent, or Firm*—Hill, Van Santen, Steadman & Simpson

[57] ABSTRACT

A refiner control continuously calculates required gearmotor output speed in opposition to the main motor drive power such that an increase in main power causes a decrease in gearmotor output speed and therefore provides a variable resolution over the entire power range of the main drive for stable refiner operation at various setpoint levels.

8 Claims, 3 Drawing Figures

APPARATUS FOR CONTROLLING A VARIABLE SPEED GEARMOTOR

BACKGROUND OF THE INVENTION

1. Field of the Invention

The present invention relates to a method and to an apparatus for refining paper stock, and more particularly to controlling a variable speed gearmotor of a disk refiner.

2. Description of the Prior Art

Presently, optimum control of disk refiner power is, at best, a compromise between various variable parameter settings and the required main motor power levels. This compromise is the result of the fixed output shaft speed of the present gearmotors and the fact that the higher the refiner main motor power level the greater the increase in this power for a corresponding incremental change in disk position. As shown in detail below, a typical main motor drive of a disk refiner, when plotted against refiner disk clearance (decreasing clearance), shows three different response requirements of a control system, which requirements are dependent on the main motor power level, but are not variable since the output rotational speed of the gearmotor is fixed. This has led to attempts at controlling the rate of adjustment through varying the pulse frequency to the gearmotor as a function of main drive power level.

Such attempts have been unsuccessful because by their varying nature, they cause the gearmotor to operate in an inrush current condition, therefore resulting in premature gearmotor failure and excessive wear on the mechanical adjustment mechanisms.

In U.S. Pat. No. 3,309,031 R. F. McMahon et al disclose a system in which the change of temperature of material being worked is measured as the change in work absorbed by the material for adjustably controlling effect of the material working device toward a predetermined value.

John A. Gundaz in his U.S. Pat. No. 3,610,541, discloses an apparatus in which the control is to be a function of process deviation from setpoint to provide output pulses for a gearmotor which have a frequency dependent on the magnitude of deviation.

SUMMARY OF THE INVENTION

The object of the present invention is to provide a control technique which continuously calculates a required gearmotor output speed in opposition to the main drive power, i.e. increase main power and decrease gearmotor output speed, and therefore provide a variable resolution over the entire power range of the main drive required for stable refiner operation at various setpoint levels. Inasmuch as the resolution is variable, the gearmotor is no longer required to operate at the inrush level of current mode, but rather operate for longer on time at reduced speeds.

The above object is achieved on the basis of the continuous solution of a linear equation using various methods for performing calculations required with a result that represents required gearmotor speed. The technique for deriving the required result is disclosed hereinbelow utilizing analog measurements and analog arithmetic devices. This, however, is but one example of solving the mathematical equation and implementing the concept. The technique could be easily implemented using digital techniques and microprocessors for arithmetic requirements. The essence of the present invention is the concept of varying the output speed of the gearmotor in an opposite relationship to the magnitude of the refiner main drive power. The basic linear equation is:

$$A=[B-(C/(D/B))]+E$$

where:

A-is the required gearmotor speed;

B-is an adjustable constant representing the maximum rpm output of the gearmotor;

C-is a real time measurement of the actual power being drawn by the main drive of the refiner;

D-is an adjustable constant representing the maximum horsepower in killowatts the refiner can deliver; and E-is an adjustable constant representing minimum gearmotor speed, this constant being contained in a variable frequency drive controller.

As will be apparent from the detailed description below, the present invention provides a method and apparatus for varying the output speed of an adjusting gearmotor attached to a disc refiner, in relationship to the magnitude of the main motor power level and results in a greatly improved control of the disc refiner action on the pulp slurry over a multitude of various power levels required to produce various types or grades of paper. Because the resolution of a gearmotor speed is variable over the range of available power of a main motor drive, an optimum set of tuning parameters can be developed which will provide improved control of the process variable, i.e. main drive power, over the complete range of main drive power levels. An improvement in controllability of the process variable, i.e. power of the main drive, therefore results in an improvement in the refined product.

BRIEF DESCRIPTION OF THE DRAWINGS

Other objects, features and advantages of the invention, its organization, construction and operation will be best understood from the following detailed description, taken in conjunction with the accompanying drawings, on which.

DESCRIPTION OF THE PREFERRED EMBODIMENTS

Figure 1:
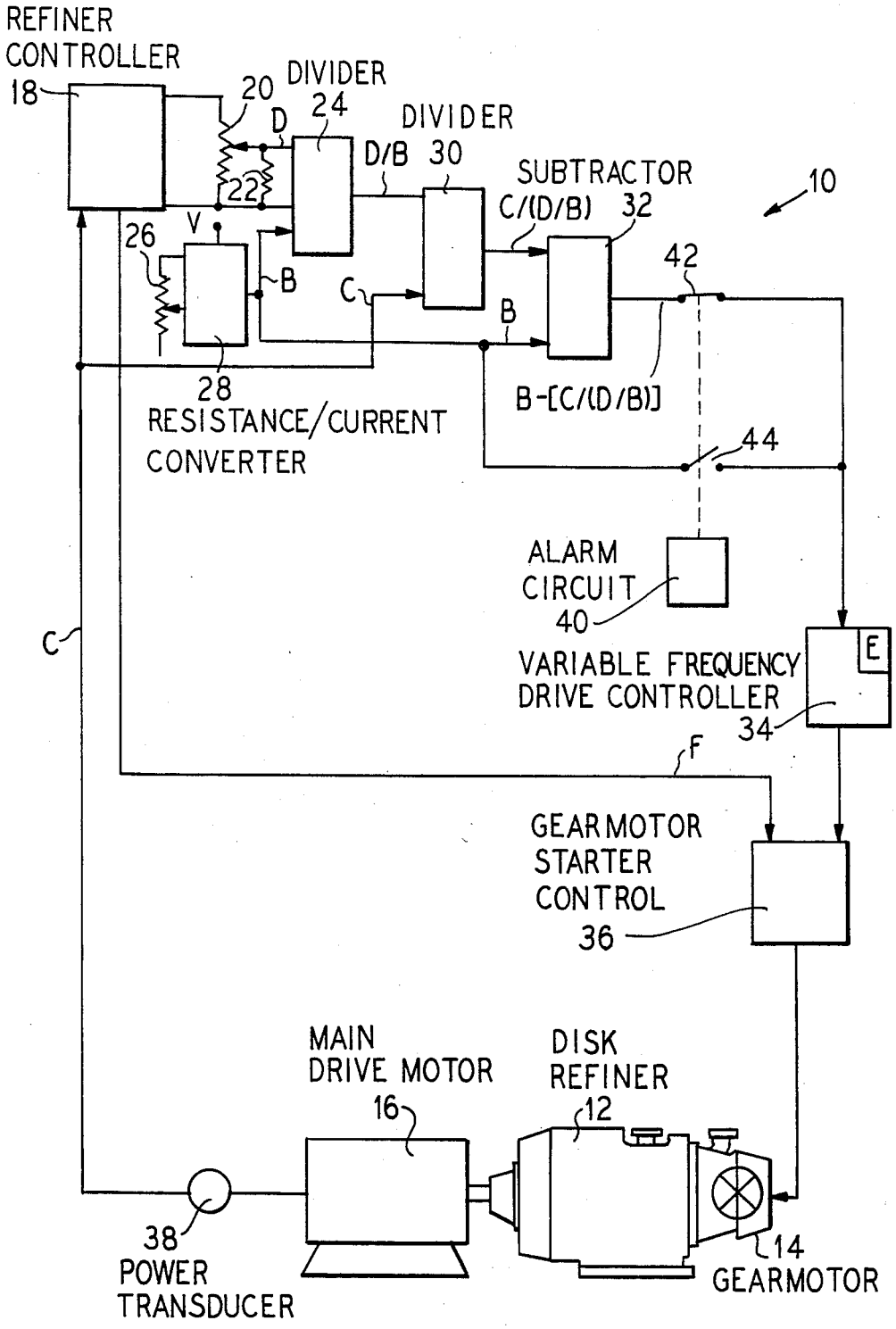
FIG. 1 is a schematic representation of a disk refiner control system constructed and operated in accordance with the present invention.

Referring to the drawings, a disc refiner system is illustrated in FIG. 1 generally at 10 as comprising a disc refiner 12 having a gearmotor 14 for adjusting disc clearance. The refiner is driven by a main motor 16. Gearmotor control and, thus, refiner operation is provided by a plurality of control elements including a refiner controller 18, a pair of dividers 24 and 30, a resistance/current converter 28, a subtractor 32, a variable frequency drive controller 34 and a gearmotor starter control 36.

For convenience, the elements of the above linear equation have been entered on the drawing.

The refiner controller 18 provides an output of, for example, 5 VDC to an adjustable resistor 20. The resistor is adjusted to provide a current D in the range of, in this example, 4–20 ma which represent available main motor power. The resistance/current converter 28 is adjustable by way of a variable resistor 26 to provide an output current B in the range of 4–20 ma representing the maximum gearmotor speed. The two currents D and B are provided to the divider 24. The divider 24 is an electronic analog divider which divides the current D by the current B to provide the quotient representing available power over maximum gearmotor speed.

The resultant current D/B is fed to a divider 30, as is a current C representing actual main motor power, the current C being provided by way of a power transducer 38 connected to the main drive motor 16. The divider 30 is also an electronic analog divider which operates to divide the current C by the current D/B. This current is fed, along with the current B, to a subtractor 32 which subtracts the output of the divider 30 from the output of the resistance/current converter 28 to provide a current which approximately represents the required gearmotor speed represented by A in the linear equation. The output of the divider 30 and the output of the subtractor 32 are both in the range of 4/20 ma.

The output of the subtractor 32 is fed, by way of a normally-closed contact 42 to the input of the variable frequency drive controller 34 setting circuits. The variable frequency drive controller is thus provided with a signal which represent the actual increase or decrease in gearmotor rotational speed required based on power level of the main drive motor. The variable frequency drive controllor as an adjustable preset minimum gearmotor speed which provides a means within the variable frequency drive controller which allows elevation of the zero point, and, therefore, the signal E is automatically added to the output signal from the subtractor 32.

The system illustrated in FIG. 1 also comprises an alarm circuit 40 for operating a pair of contacts 42 and 44. These switches are known as automatic unload alarms (AUA) and are actually simple electronic switching devices. Their operation is dependent on the alarm monitoring circuits contained within the refiner controller and here shown separately for simplicity. The purpose of the AUA devices is to automatically bring the variable frequency drive controller to maximum speed by applying a signal (20 ma) to the variable frequency drive controller frequency setting circuit. This, combined with the operating sequence of the gearmotor starter controller, results in the gearmotor operating in the "out" "fast" mode, thus providing the required protection for the refiner when an alarm condition exists. The switches 42 and 44 are illustrated in the normal position for a no alarm condition in the refiner system. In the position illustrated, the output signal of the substractor 32 is fed to the variable frequency drive frequency control circuits. Under an alarm condition, the switch 42 is opened and the switch 44 is closed so that the output of the resistance/current converter 28 is fed to the variable frequency drive controller 34. This is the current B which represents maximum gearmotor speed so that the gearmotor speed is elevated to maximum under an alarm condition.

The variable frequency drive controller, as mentioned above, adds the minimum gearmotor speed to the output of the subtractor 32 and feeds the same to the gearmotor starter control 36 for operating the gearmotor 14 at the required gearmotor speed. The gearmotor starter control 36 also receives a gearmotor directional control signal from the refiner controller 18.

Figure 2:
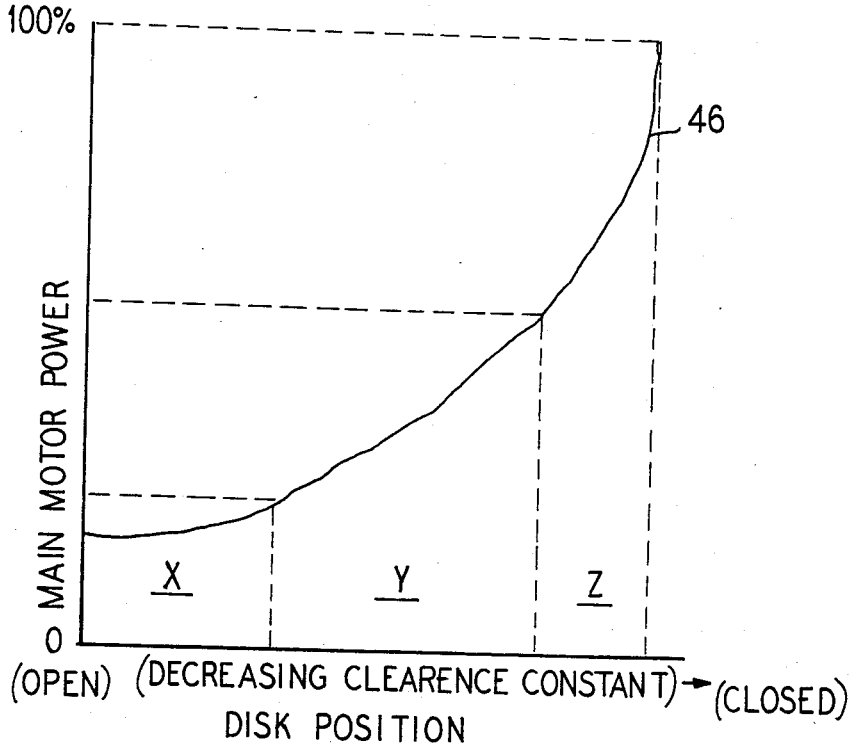
FIG. 2 is a graphic illustration of main motor power plotted with respect to refiner disc clearance and shows the aforementioned three different response requirements of a control system which are dependent on main motor power but which are not variable since the output rotational speed of the gear motor is fixed.

Turning to FIG. 2, a typical power current 46 is illustrated for the main motor power with respect to the disk position. FIG. 2 illustrates the three different response requirements X, Y and Z of a control system and shows that the main motor power increases exponentially with decreasing disk clearance.

Figure 3:
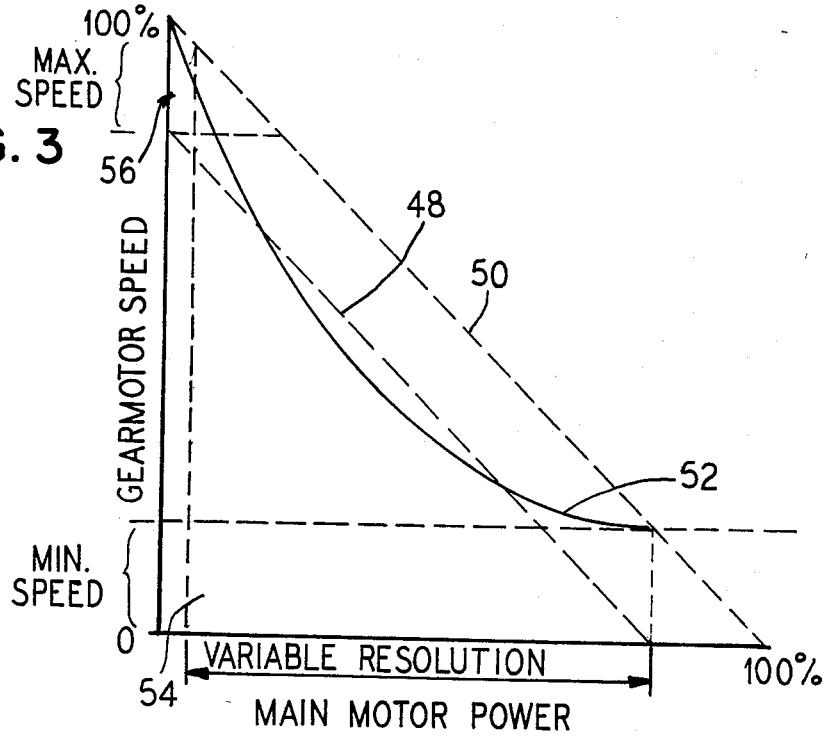
FIG. 3 is a graphic illustration of the resultant variable resolution provided by the present invention and shows main motor power plotted against gearmotor speed.

FIG. 3 illustrates, for main motor power verses gearmotor speed, three curves, namely a curve 48 representing an adjustable slope through maximum speed adjustment, a curve 50 representing the gearmotor speed and a curve 52 representing a typical power curve of a main drive motor. FIG. 3 also illustrates a minimum speed area 54 and a maximum speed area 56.

With FIGS. 2 and 3 in mind, the following examples given for a system constructed and operated in accordance with the present invention.

EXAMPLE

| | |
|---|---|
| Main Drive Horsepower = | 200 |
| Max. Available Power = | 200 HP × .746 = 149.2 KW |
| Max. Gearmotor Speed = | 900 RPM |
| Min. Gearmotor Speed = | 50 RPM |
| Range of Gearmotor Speed = | 850 RPM |
| Set Max. Speed = | 850 RPM |
| Assume No Load HP = | 70 HP × .746 = 52.2 KW |

| Main Motor Power Actual | Main Motor Power Available | Max. GM Speed | Min. GM Speed | Gearmotor Speed |
|---|---|---|---|---|
| 149.2 KW | 149.2 KW | 850 RPM | 50 RPM | 50 RPM |
| 139.2 KW | 149.2 KW | 850 RPM | 50 RPM | 106 RPM |
| 129.2 KW | 149.2 KW | 850 RPM | 50 RPM | 163.8 RPM |
| 119.2 KW | 149.2 KW | 850 RPM | 50 RPM | 220 RPM |

The foregoing illustrates that as the actual measured main power varies, the output speed of the gearmotor varies in opposition thereto.

The actual implementation with respect to FIG. 1 was constructed of a plurality of arithmetic analog modules. However, the same system can be constructed employing a microprocessor and is not limited to the specific structural embodiments set forth herein.

The components employed for a working embodiment of the invention are set forth below in tabular form with the exception of the variable frequency drive controller, the refiner controller and the gearmotor starter control. The variable frequency drive controller is manufactured by several firms, such as Emerson Electric and Allen Bradley. In the working embodiment a Emerson Electric variable frequency drive controller was employed. The refiner controller and the gearmotor starter control are manufactured by Beloit Jones Division, Beloit, Corporation, Dalton, Mass., under the respective drawing numbers 42-400983-G1 and 42-400788. The other components are

| COMPONENTS | |
|---|---|
| Ref. | Manufacturer Designation |
| 24,30 | Signal Division Module AP 4420<br>Action Instruments, San Diego, CA |

-continued

| COMPONENTS | |
|---|---|
| Ref. | Manufacturer Designation |
| 28 | Amplifier/Conditioner Module AP 4003 Action Instruments, San Diego, CA |
| 32 | Signal Difference Module AP 4408 Action Instruments, San Diego, CA |
| 38 | 3Ø,3 Wire Watts Transducer XL31K5A4 Scientific Columbus, Columbus, OH |

Attention is again invited to the fact that the refiner controller has the task of monitoring the actual power of the main drive with respect to a setpoint. As the actual power deviates above and below the setpoint, the controller provides a corresponding signal as a direction control signal to the gearmotor starter control 36 so that the actual power is again brought back to the setpoint. Therefore, as the main motor power increases, the gearmotor is provided control via the gearmotor starter control 36 so that the gearmotor is operated in opposition to the main motor and thus provides the variable resolution illustrated in FIG. 3.

Although I have described my invention by reference to particular illustrative embodiments thereof, many changes and modifications of the invention may become apparent to those skilled in the art without departing from the spirit and scope of the invention. I therefore intend to include within the patent warranted hereon all such changes and modifications as may reasonably and properly be included within the scope of my contribution to the art.

I claim:

1. Apparatus for controlling operation of a refiner which is driven by a main motor having a predetermined available power and which has disks whose separation is controlled by a variable speed auxiliary motor having a predetermined maximum speed and which disks may be operated in two directions, said apparatus comprising:

first means for producing; a first signal value representing the available power of the main motor, a second signal value representing the maximum speed of the auxiliary motor and a third signal value representing a quantity which is equal to the first signal value divided by the second signal value;

second means connected to the main motor for producing a fourth signal value representing actual main motor power;

third means connected to said first and second means for producing, in response to the third and fourth signal values, a fifth signal value representing a quanity of the fourth signal value divided by the third signal value;

fourth means connected to said first and third means for producing a sixth signal value having a magnitude representing a quanity which is equal to the fifth signal value substracted from the second signal value; and fifth means connected to said fourth means and to the auxiliary motor for driving the auxiliary motor in accordance with the magnitude of the sixth signal value.

2. The apparatus of claim 1, wherein said first means comprises:

a first adjustable source for producing a first current which is represented by the first signal value;

a second adjustable source for producing a second current which is represented by the second signal value; and a first divider connected to said first and second adjustable sources for producing, in response to the first and second currents, a third current which is represented by the third signal value.

3. The apparatus of claim 2, wherein said second means comprises:

a power transducer for producing a fourth current which is represented by the fourth signal value.

4. The apparatus of claim 3, wherein said third means comprises:

a further divider connected to the first divider and to said power transducer for producing a fifth current which is represented by the fifth signal value, in response to the third and fourth currents.

5. The apparatus of claim 4, wherein said fourth means comprises:

a subtractor connected to said second adjustable source and to said further divider for producing a sixth current which is represented by the sixth signal value, in response to the second and fifth currents.

6. The apparatus of claim 5, wherein said fifth means comprises:

an auxiliary motor control connected to the auxiliary motor; and a variable frequency drive controller connected to said auxiliary motor control and to said subtractor and responsive to the sixth current to drive said auxiliary motor via said auxiliary motor drive control at the frequency determined by the magnitude of said sixth current.

7. The apparatus of claim 6, wherein said first means comprises:

a refiner controller connected to said power transducer and to said auxiliary motor control and responsive to the fouth current which transgresses a predetermined value to produce a corresponding direction control signal to said auxiliary motor control to controlling direction of rotation of said auxiliary motor.

8. The apparatus of claim 6, and further comprising:

alarm means for monitoring the refiner for an alarm condition, including switch means conneced to said second adjustable source, to said subtractor and to said variable frequency drive controller, said switch means being operated to substitute the second current in place of the sixth current during an alarm condition to operate the auxiliary motor at its maximum speed.

* * * * *

UNITED STATES PATENT AND TRADEMARK OFFICE

CERTIFICATE OF CORRECTION

PATENT NO. : 4,589,598

DATED : May 20, 1986

INVENTOR(S) : John M. Ellery, Sr.

It is certified that error appears in the above—identified patent and that said Letters Patent is hereby corrected as shown below:

Column 6, Line 47; Delete "fouth" and insert therefor "fourth"

Column 6, Line 49; Delete "to" and insert therefor "for"

Column 6, Line 50; Delete "to" and insert therefor "for"

Signed and Sealed this

Seventeenth Day of February, 1987

*Attest:*

DONALD J. QUIGG

*Attesting Officer*

*Commissioner of Patents and Trademarks*